US007775464B2

(12) United States Patent
Shoji et al.

(10) Patent No.: US 7,775,464 B2
(45) Date of Patent: Aug. 17, 2010

(54) ELECTROMAGNETIC FUEL INJECTION VALVE

(75) Inventors: Manabu Shoji, Miyagi (JP); Kiyomi Honda, Miyagi (JP)

(73) Assignee: Keihin Corporation, Tokyo (JP)

( * ) Notice: Subject to any disclaimer, the term of this patent is extended or adjusted under 35 U.S.C. 154(b) by 88 days.

(21) Appl. No.: 12/038,012

(22) Filed: Feb. 27, 2008

(65) Prior Publication Data

US 2008/0217438 A1 Sep. 11, 2008

(30) Foreign Application Priority Data

Mar. 9, 2007 (JP) ..... 2007-060254

(51) Int. Cl.
*F02M 51/00* (2006.01)

(52) U.S. Cl. ..... 239/585.1; 239/585.5; 239/533.2; 239/533.9; 239/533.15

(58) Field of Classification Search ..... 239/5, 239/533.2, 533.3, 533.9, 533.15, 584–585.5
See application file for complete search history.

(56) References Cited

U.S. PATENT DOCUMENTS 5,465,911 A * 11/1995 Hall ..... 239/585.4
5,613,640 A * 3/1997 Furuya et al. ..... 239/585.5
5,996,910 A * 12/1999 Takeda et al. ..... 239/585.1
6,119,658 A * 9/2000 Jehle et al. ..... 123/470
6,685,112 B1 * 2/2004 Hornby et al. ..... 239/585.1
6,851,630 B2 * 2/2005 Nagaoka et al. ..... 239/585.1
2006/0243829 A1 * 11/2006 Oomori et al. ..... 239/584

FOREIGN PATENT DOCUMENTS

JP 2006-2636 A 1/2006

* cited by examiner

*Primary Examiner*—Len Tran
*Assistant Examiner*—Jason J Boeckmann
(74) *Attorney, Agent, or Firm*—Arent Fox LLP

(57) ABSTRACT

In an electromagnetic fuel injection valve, a valve housing is formed by sequentially connecting a valve seat member, a magnetic cylinder, a nonmagnetic collar, and a stationary core. A coil housing is fittingly fixed to an outer periphery of the magnetic cylinder, and houses a coil assembly provided in an outer periphery of the stationary core. The coil housing includes a shell part surrounding the coil housing, an annular bent part bent radially inward from a front end of the shell part, and a cylindrical boss part projecting forward from a front end of the annular bent part. An inner peripheral surface of the annular bent part and an inner peripheral surface of at least a rear half part of the boss part are shrinkage-fitted to an outer peripheral surface of the magnetic cylinder. Thus, it is possible to eliminate distortion propagating to the magnetic cylinder, and eliminate a gap from fitted portions between the magnetic cylinder and the coil housing to improve magnetic efficiency, thereby exerting stabile fuel injection characteristics.

4 Claims, 2 Drawing Sheets

ELECTROMAGNETIC FUEL INJECTION VALVE

RELATED APPLICATION DATA

The Japanese priority application No. 2007-60254 upon which the present application is based is hereby incorporated in its entirety herein by reference.

BACKGROUND OF THE INVENTION

1. Field of the Invention

The present invention relates to an improvement of an electromagnetic fuel injection valve comprising: a valve housing which includes: a valve seat member having a valve hole at a front end thereof, and a valve seat member leading to an inner end of the valve hole; a magnetic cylinder connected to a rear end of the valve seat member; and a stationary core connected to a rear end of the magnetic cylinder via a nonmagnetic collar; a valve element housed in the valve seat member so as to open and close the valve hole in cooperation with the valve seat; a movable core housed in the magnetic cylinder, the movable core being connected to the valve element and facing a front end of the stationary core; a coil housing fittingly fixed to an outer periphery of the magnetic cylinder, and housing a coil assembly provided in an outer periphery of the stationary core.

2. Description of the Related Art

Such an electromagnetic fuel injection valve is already known from, for example, Japanese Patent Application Laid-open No. 2006-2636.

In the conventional electromagnetic fuel injection valve, a coil housing, a stationary core, a movable core, and a magnetic cylinder form a magnetic path through which a magnetic flux generating an attraction force between the stationary core and the movable core passes, when electricity is supplied to a coil assembly. Also, in the conventional electromagnetic fuel injection valve, a press-fitting process is used to fittingly fix the coil housing to the magnetic cylinder. In this press-fitting process, an imbalanced distortion is generated in the magnetic cylinder due to center deviance between the magnetic cylinder and the coil housing at the time of press-fitting operation, and the distortion may propagate to the valve seat member. The propagation of distortion to the valve seat member inhibits the valve element from opening accurately, and brings the fuel injection characteristics in disorder. In the press-fitting structure between the magnetic cylinder and the coil housing, a small-diameter part is required to be formed on an outer peripheral surface of a rear end of the magnetic cylinder in order to facilitate initial fitting of the coil housing, resulting in that a gap is generated after the press fitting between the small-diameter part of the magnetic cylinder and the coil housing. This gap provides resistance in the magnetic path to some degree.

SUMMARY OF THE INVENTION

The present invention has been made in view of the above circumstances, and an object thereof is to provide an electromagnetic fuel injection valve which can exert stable fuel injection characteristics, wherein propagation of distortion to a valve seat member is eliminated, and a gap is eliminated from fitted portions between a magnetic cylinder and a coil housing to improve magnetic efficiency.

To achieve the above object, according to a first aspect of the present invention, there is provided an electromagnetic fuel injection valve comprising: a valve housing which includes: a valve seat member having a valve hole at a front end thereof, and a valve seat member leading to an inner end of the valve hole; a magnetic cylinder connected to a rear end of the valve seat member; and a stationary core connected to a rear end of the magnetic cylinder via a nonmagnetic collar; a valve element housed in the valve seat member so as to open and close the valve hole in cooperation with the valve seat; a movable core housed in the magnetic cylinder, the movable core being connected to the valve element and facing a front end of the stationary core; a coil housing fittingly fixed to an outer periphery of the magnetic cylinder, and housing a coil assembly provided in an outer periphery of the stationary core, wherein the coil housing includes: a shell part surrounding the coil housing; an annular bent part bent radially inward from a front end of the shell part; and a cylindrical boss part projecting forward from a front end of the annular bent part; and wherein an inner peripheral surface of the annular bent part and an inner peripheral surface of at least a rear half part of the boss part are shrinkage-fitted to an outer peripheral surface of the magnetic cylinder.

With the first feature of the present invention, the inner peripheral surfaces of the annular bent part and the boss part are fitted exactly to the outer peripheral surface of the magnetic cylinder without center deviance, and also they are reliably brought into close contact with the outer peripheral surface of the magnetic cylinder such that they evenly tighten the outer peripheral surface of the magnetic cylinder. Therefore, a gap is eliminated from between the magnetic cylinder and the coil housing to reduce a resistance in the magnetic path, whereby the magnetic efficiency is improved, and thus the valve-opening response of the valve element is improved. Also, since the inner peripheral surfaces of the annular bent part and the boss part evenly tighten the outer peripheral surface of the magnetic cylinder, an imbalanced distortion can be prevented from being generated in the magnetic cylinder, and also the propagation of distortion from the magnetic cylinder to the valve seat member can be prevented. Therefore, the valve element is reliably closed to stabilize fuel injection characteristics in addition to the improvement in magnetic efficiency.

According to a second aspect of the present invention, in addition to the first feature, a gap is provided between an inner peripheral surface of a front half part of the boss part and the outer peripheral surface of the magnetic cylinder in order avoid contact under pressure therebetween.

With the second feature of the present invention, in the shrinkage fitting, the distortion propagating from the boss part to the magnetic cylinder can be minimized.

According to a third aspect of the present invention, in addition to the first or second feature, a positioning flange is integrally formed in the magnetic cylinder so as to receive a front end of the boss part and define a fitting depth between the coil housing and the magnetic cylinder.

With the third feature of the present invention, the fitting depth between the coil housing and the magnetic cylinder can be determined easily and accurately, thereby improving the assemblability and the dimensional accuracy of the valve housing.

The above-mentioned object, other objects, characteristics, and advantages of the present invention will become apparent from a preferred embodiment, which will be described in detail below with reference to the attached drawings.

DESCRIPTION OF THE PREFERRED EMBODIMENT

Figure 1:
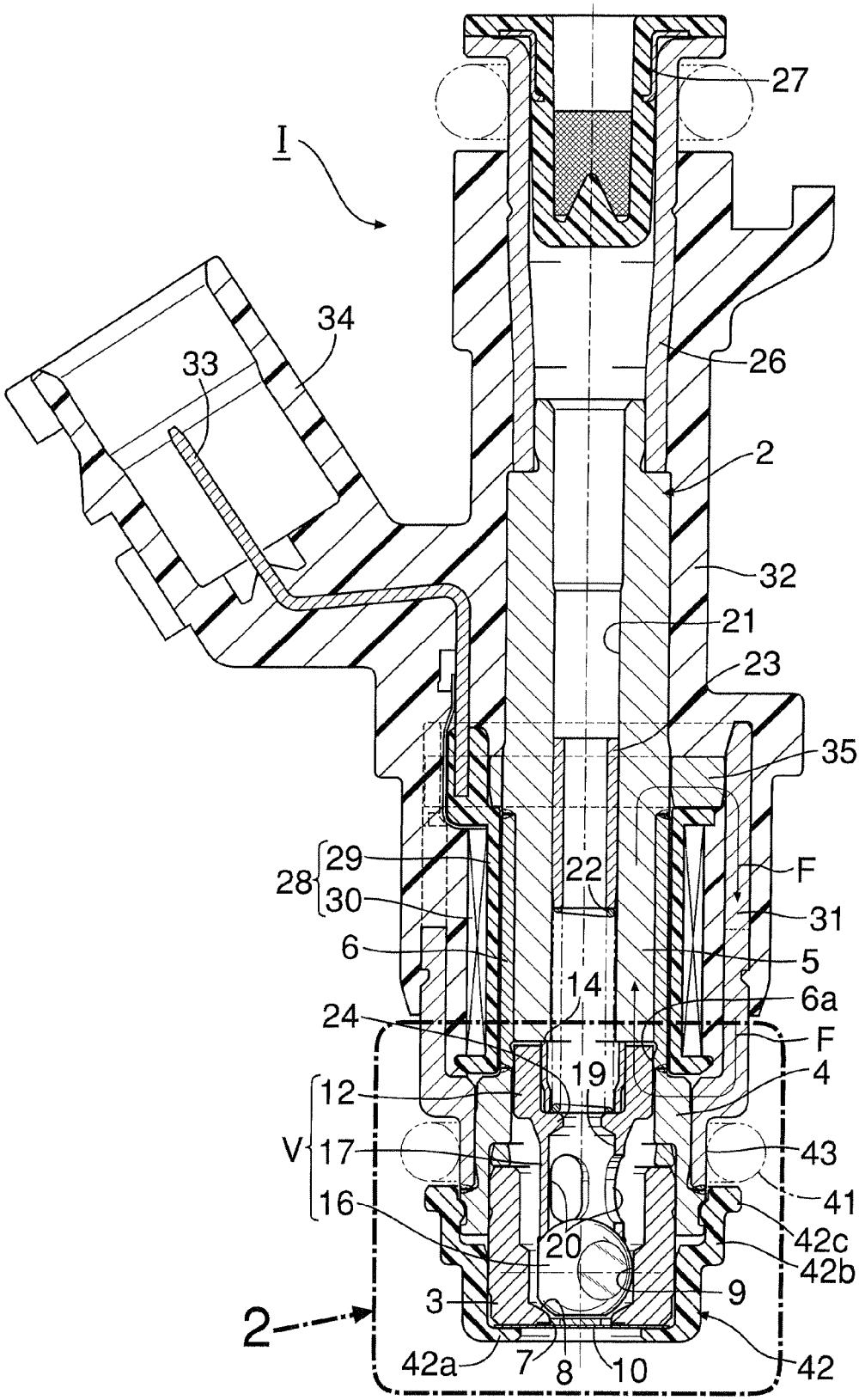
FIG. 1 is a longitudinal sectional view of an electromagnetic fuel injection valve according to an embodiment of the present invention.

In FIG. 1, a fuel injection valve I comprises a valve housing 2 which includes: a cylindrical valve seat member 3 having a valve seat 8 at a front end thereof; a magnetic cylinder 4 press-fitted to an outer peripheral surface of a rear end of the valve seat member 3, and liquid-tightly welded thereto; a nonmagnetic collar 6 coaxially abutting on a rear end of the magnetic cylinder 4, and liquid-tightly welded thereto; a stationary core 5 fitted to an inner peripheral surface of the nonmagnetic collar 6, and welded to a rear end of the nonmagnetic collar 6; and a fuel inlet tube 26 fitted to a rear end of the stationary core 5, and liquid-tightly welded thereto.

The valve seat member 3 includes a valve hole 7 penetrating a central part of a conical valve seat 8, and a cylindrical guide hole 9 leading to a rear end of the valve seat 8.

A front end portion of the nonmagnetic collar 6 that does not fit to the stationary core 5 is left as a guide portion 6*a*. A valve assembly V is housed in the valve housing 2 extending from the guide portion 6*a* to the valve seat member 3. The valve assembly V includes: a spherical valve element 16 slidably fitted in the guide hole 9, and operated to move toward and away from the valve seat 8 so as to open and close the valve I; a cylindrical movable core 12 slidably fitted to the guide portion 6*a*, and housed in the magnetic cylinder 4; and a rod part 17 providing connection between the movable core 12 to the valve element 16. The rod part 17 is molded integrally with the movable core 12, and is fixed by welding to the valve element 16. The movable core 12 is arranged so as to face an attraction surface at a front end of the stationary core 5.

Figure 2:
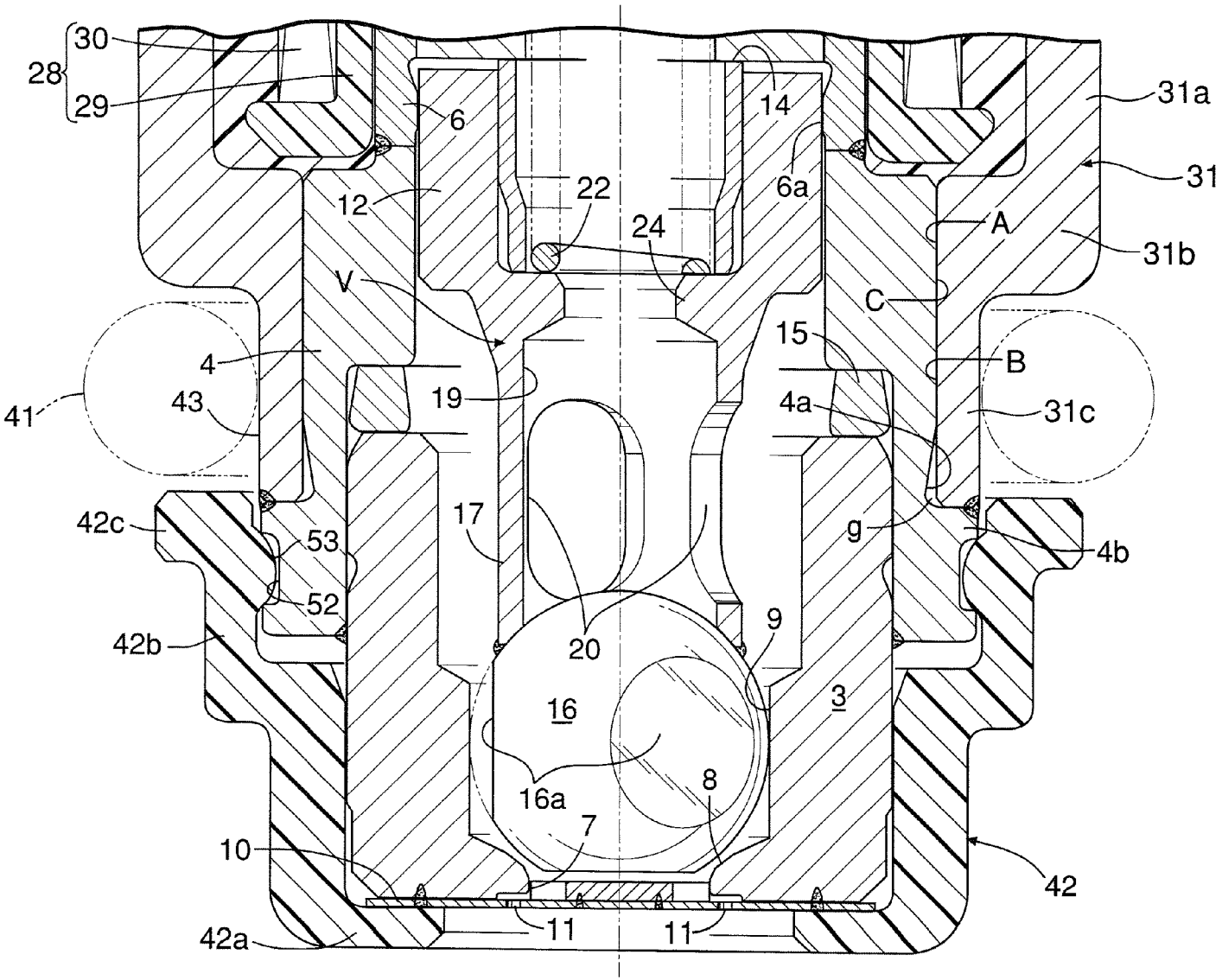
FIG. 2 is an enlarged view of Part 2 of FIG. 1.

As shown in FIGS. 1 and 2, the valve assembly V includes: a longitudinal hole 19 extending from a rear end surface of the movable core 12 to a position in front of the valve element 16; a plurality of transverse holes 20 communicating the longitudinal hole 19 with an outer peripheral surface of the rod part 17; and a plurality of chamfered parts 16*a* formed on an outer peripheral surface of the valve element 16 so as to lead to the transverse holes 20. An annular spring seat 24 is formed in an intermediate portion of the longitudinal hole 19 so as to bulge from an inner wall of the movable core 12.

The stationary core 5 has, at its central part, a longitudinal hole 21 communicating with the longitudinal hole 19 in the valve assembly V. A valve spring 22 is provided under compression between a pipe-shaped retainer 23 (see FIG. 1) fittingly fixed in the longitudinal hole 21 and the spring seat 24. The valve spring 22 urges the valve assembly V in a direction such that the valve assembly V is seated on the valve seat 8 of the valve element 16. A cylindrical stopper member 14 having a high hardness is fixed by press fitting to an inner peripheral surface of the movable core 12. A front end in the press-fitting direction of the stopper member 14 has a reduced diameter so as to facilitate the press fitting thereof into the movable core 12. The valve spring 22 is arranged such that it penetrates a hollow part of the stopper member 14, and is slidably supported by the reduced-diameter part of the stopper member 14.

The stopper member 14 has an outer end projecting slightly from the attraction surface at the rear end of the movable core 12, and is normally positioned so as to face the attraction surface at the front end of the stationary core 5 with a gap corresponding to the valve opening stroke of the valve assembly V provided therebetween. Therefore, even when the valve assembly V is open (FIGS. 1 and 2 show the valve opening state), that is, even when the stopper member 14 comes into contact with the attraction surface at the front end of the stationary core 5, a gap is present between the stationary core 5 and the movable core 12. The valve opening stroke of the valve assembly V is adjusted by the selection of a shim 15 interposed between the axial abutment surfaces of the magnetic cylinder 4 and the valve seat member 3.

A coil assembly 28 is fittingly mounted to the outer periphery of the valve housing 2. The coil assembly 28 includes a bobbin 29 fitted on the nonmagnetic collar 6, and a coil 30 wound around the bobbin 29. A coil housing 31 made of a magnetic material for housing the coil assembly 28 is connected to the valve housing 2, as described below.

The coil housing 31 includes: a shell part 31*a* surrounding the coil housing 31; an annular bent part 31*b* bent radially inward from a front end of the shell part 31*a*; and a cylindrical boss part 31*c* projecting forward from a front end of the annular bent part 31*b*. The inner peripheral surfaces A and B of the annular bent part 31*b* and the boss part 31*c* are formed to have the same diameter so as to be continuous to each other. The inner peripheral surfaces A and B of the annular bent part 31*b* and the boss part 31*c* are fittingly fixed to the outer peripheral surface C of the magnetic cylinder 4 by shrinkage fitting.

Specifically, when the diameter of the outer peripheral surface C of the magnetic cylinder 4, to which the annular bent part 31*b* and the boss part 31*c* are fitted, is denoted as D1, the diameter D2 of the inner peripheral surfaces A and B of the annular bent part 31*b* and the boss part 31*c* is set so that the relationship (D2<D1) is established at normal temperatures before being fitted to the magnetic cylinder 4.

In the shrinkage fitting, the coil housing 31 is heated and expanded into a state where the diameter D2 of the inner peripheral surfaces A and B of the annular bent part 31*b* and the boss part 31*c* is slightly larger than the diameter D1 of the magnetic cylinder 4; in this state, the inner peripheral surfaces A and B of the annular bent part 31*b* and the boss part 31*c* are loosely fitted to the outer peripheral surface of the magnetic cylinder 4; ad then the coil housing 31 is cooled so that the annular bent part 31*b* and the boss part 31*c* are cooled and shrunk. Therefore, the inner peripheral surfaces A and B tighten the outer peripheral surface C of the magnetic cylinder 4, whereby the surfaces A and B come into close contact with the surface C.

A taper part 4*a* is formed in a front half part of the outer peripheral surface C of the magnetic cylinder 4 facing the inner peripheral surface of the boss part 31*c*. The taper part 4*a* has a diameter decreasing forward, whereby a gap g is provided between the front half part of the boss part 31*c* and the magnetic cylinder 4 so as to prevent contact under pressure therebetween.

Also, the magnetic cylinder 4 is integrally formed with a positioning flange 4*b* that receives the front end of the boss part 31*c* and defines a fitting depth between the coil housing 31 and the magnetic cylinder 4. The abutting portions of the positioning flange 4*b* and the boss part 31*c* are liquid-tightly welded over their entire periphery. An annular locking groove 52 is provided in an outer peripheral surface of the positioning flange 4*b*.

The rear end of the coil housing 31 is connected to the outer peripheral surface of the stationary core 5 via a C-shaped or annular yoke 35. Therefore, the coil housing 31, the yoke 35, the stationary core 5, the movable core 12, and the magnetic cylinder 4 form a magnetic path through which a magnetic flux passes when electricity is supplied to the coil 30.

An injector plate 10 is annularly joined, along its peripheral portion, to the front end surface of the valve seat member 3. A plurality of fuel injection holes 11 are formed in the injector plate 10 so as to communicate with the valve hole 7. A synthetic resin cylindrical cap 42 is attached by press fitting to the outer peripheral surface of the valve seat member 3. The cylindrical cap 42 has an annular bottom part 42*a* that is in contact with the injector plate 10 so as to surround a group of the fuel injection hole 11. A cylindrical extension part 42*b* is integrally formed in the cap 42 so as to be fitted to the outer peripheral surface of the positioning flange 4*b*. An elastic annular locking claw 53 is projectingly provided integrally on the inner peripheral surface of the extension part 42*b*.

Further, a flange part 42*c* is formed in the outer periphery of the cylinder extension part 42*b*. In the outer periphery of the boss part 31*c* of the coil housing 31, a seal groove 43 for holding a seal member 41 such as an O-ring is defined between the flange part 42*c* and the annular bent part 31*b*. When the front end of the electromagnetic fuel injection valve I is fittingly mounted in an attachment hole provided in an intake system member of an engine, the seal member 41 comes into close contact with the inner peripheral surface of the attachment hole to thereby seal the attachment hole.

Referring again to FIG. 1, the fuel inlet tube 26 is fitted to the outer peripheral surface of the rear end of the stationary core 5, and liquid-tightly welded thereto. The interior of the fuel inlet tube 26 communicates with the interior of the retainer 23. A fuel filter 27 is mounted at an inlet of the fuel inlet tube 26.

A covering member 32 made of a hard synthetic resin is formed by injection molding on outer peripheral surfaces of the rear half part of the coil housing 31 and the fuel inlet tube 26. In this process, a coupler 34 projecting to one side is molded integrally in an intermediate part of the covering member 32. The coupler 34 holds a feeder terminal 33 leading to the coil 30.

Next, the operation of the embodiment will be described.

In the operation of the electromagnetic fuel injection valve I, in a state where the coil 30 is de-energized, the valve assembly V is pushed forward by the urging force of the valve spring 22, and the valve element 16 is seated on the valve seat 8. Meanwhile, fuel is fed under pressure from a fuel pump (not shown) to the fuel inlet tube 26, passes through the hollow parts of the stationary core 5 and the valve assembly V, and is caused to stand by in the valve seat member 3.

When the coil 30 is excited by supply of electricity, a magnetic flux F is generated by the excitation, and runs through a magnetic path formed by the coil housing 31, the yoke 35, the stationary core 5, the movable core 12, and the magnetic cylinder 4 to generate a magnetic force which causes the movable core 12 to be attracted to the stationary core 5 against a set load of the valve spring 22, whereby the valve element 16 is separated from the valve seat 8 (see FIG. 2) of the valve seat member 3. Therefore, a high-pressure fuel in the valve seat member 3 advances toward the valve hole 7 along the valve seat 8, and is injected through the fuel injection holes 11 while being atomized.

When the supply of electricity to the coil 30 is cut, the movable core 12 is separated from the stationary core 5 by the urging force of the valve spring 22, and the valve element 16 is seated on the valve seat 8 to close the valve hole 7, thereby stopping the fuel injection from the fuel injection hole 11.

Since the inner peripheral surfaces A and B at the front end of the coil housing 31, that is, the inner peripheral surfaces A and B of the annular bent part 31*b* and the boss part 31*c* are shrinkage-fitted to the outer peripheral surface C of the magnetic cylinder 4, the inner peripheral surfaces A and B of the annular bent part 31*b* and the boss part 31*c* are fitted exactly to the outer peripheral surface C of the magnetic cylinder 4 without center deviance, and also they are reliably brought into close contact with the outer peripheral surface C of the magnetic cylinder 4 such that they evenly tighten the outer peripheral surface C of the magnetic cylinder 4. Therefore, a gap is eliminated from between the magnetic cylinder 4 and the coil housing 31 to reduce the resistance in the magnetic path, whereby the magnetic efficiency is improved, and thus the valve-opening response of the valve element 16 is improved.

Since the inner peripheral surfaces A and B of the annular bent part 31*b* and the boss part 31*c* evenly tighten the outer peripheral surface C of the magnetic cylinder 4, an unbalanced distortion is prevented from being generated in the magnetic cylinder 4, and also the propagation of distortion from the magnetic cylinder 4 to the valve seat member 3 is prevented. Therefore, the valve element 16 is reliably closed to stabilize the fuel injection characteristics in addition to the improvement of magnetic efficiency.

Further, since the gap g is provided between the boss part 31*c* and the outer peripheral surface of the magnetic cylinder 4 in order avoid contact under pressure therebetween, the distortion propagating from the boss part 31*c* to the magnetic cylinder 4 is minimized in the process of the shrinkage fitting.

Furthermore, since the positioning flange 4*b* is integrally formed in the magnetic cylinder 4 so as to receive the front end of the boss part 31*c* and define a fitting depth between the coil housing 31 and the magnetic cylinder 4, the fitting depth between the coil housing 31 and the magnetic cylinder 4 is determined easily and accurately, thereby improving the assemblability and the dimensional accuracy of the valve housing 2.

The present invention is not limited to the above-described embodiment, and various changes in design can be made without departing from the subject matter of the present invention. For example, the cap 42 can be made of a metal that is softer than the valve seat member 3.

What is claimed is:

1. An electromagnetic fuel injection valve comprising:

a valve housing which includes:

a valve seat member having a valve hole at a front end thereof, and a valve seat leading to an inner end of the valve hole;

a magnetic cylinder connected to a rear end of the valve seat member; and a stationary core connected to a rear end of the magnetic cylinder via a nonmagnetic collar abutting the rear end of the magnetic cylinder;

a valve element housed in the valve seat member so as to open and close the valve hole in cooperation with the valve seat;

a movable core housed in the magnetic cylinder, the movable core being connected to the valve element and facing a front end of the stationary core;

a coil housing fittingly fixed to an outer periphery of the magnetic cylinder, and housing a coil assembly provided in an outer periphery of the stationary core, wherein the coil housing includes:

a shell part surrounding the coil housing;

an annular bent part bent radially inward from a front end of the shell part; and a cylindrical boss part projecting forward from a front end of the annular bent part;

wherein an inner peripheral surface of the annular bent part and an inner peripheral surface of at least a rear half part of the boss part are shrinkage-fitted to an outer peripheral surface of the magnetic cylinder; and wherein a positioning flange is integrally formed in the magnetic cylinder so as to receive a front end of the boss part and define a fitting depth between the coil housing and the magnetic cylinder.

2. The electromagnetic fuel injection valve according to claim 1, wherein a gap is provided between an inner peripheral surface of a front half part of the boss part and the outer peripheral surface of the magnetic cylinder in order to avoid contact under pressure therebetween.

3. The electromagnetic fuel injection valve according to claim 1, further comprising a cylindrical cap fitted to an outer peripheral surface of the valve seat member.

4. The electromagnetic fuel injection valve according to claim 3, wherein the cylindrical cap is integrally formed with a cylindrical extension part fitted to an outer peripheral surface of the positioning flange.

* * * * *